US011839906B2

(12) United States Patent
Hoshiba et al.

(10) Patent No.: US 11,839,906 B2
(45) Date of Patent: Dec. 12, 2023

(54) ULTRASONIC TREATMENT APPARATUS

(71) Applicant: NIPPON STEEL ENGINEERING CO., LTD., Tokyo (JP)

(72) Inventors: Eri Hoshiba, Tokyo (JP); Hiromitsu Date, Tokyo (JP); Shinji Tokumaru, Tokyo (JP); Shintaro Obara, Tokyo (JP); Yuta Ozaki, Tokyo (JP); Nobuyuki Hayashi, Tokyo (JP); Masaki Ando, Tokyo (JP)

(73) Assignee: NIPPON STEEL ENGINEERING CO., LTD., Tokyo (JP)

( * ) Notice: Subject to any disclaimer, the term of this patent is extended or adjusted under 35 U.S.C. 154(b) by 0 days.

(21) Appl. No.: 17/787,179

(22) PCT Filed: Dec. 17, 2020

(86) PCT No.: PCT/JP2020/047145
§ 371 (c)(1),
(2) Date: Jun. 17, 2022

(87) PCT Pub. No.: WO2021/125260
PCT Pub. Date: Jun. 24, 2021

(65) Prior Publication Data

US 2023/0037005 A1 Feb. 2, 2023

(30) Foreign Application Priority Data

Dec. 19, 2019 (JP) ..... 2019-228830

(51) Int. Cl.
*B08B 3/12* (2006.01)

(52) U.S. Cl.
CPC ..... *B08B 3/12* (2013.01)

(58) Field of Classification Search
None
See application file for complete search history.

(56) References Cited

U.S. PATENT DOCUMENTS 678,913 A * 7/1901 Stephenson ..... B65D 90/08 220/4.16
4,528,652 A * 7/1985 Horner ..... G10K 11/165 367/176

(Continued)

FOREIGN PATENT DOCUMENTS

CN 105170562 A 12/2015
JP 55-114379 A 9/1980

(Continued)

OTHER PUBLICATIONS

International Search Report for PCT/JP2020/047145 (PCT/ISA/210) dated Mar. 2, 2021, 6 Pages.

(Continued)

*Primary Examiner* — Eric W Golightly
*Assistant Examiner* — Arlyn I Rivera-Cordero
(74) *Attorney, Agent, or Firm* — Birch, Stewart, Kolasch & Birch, LLP

(57) ABSTRACT

An ultrasonic treatment apparatus according to the present invention includes: a treatment tank capable of containing a treatment object and a treatment liquid for immersing the treatment object; and an ultrasonic application mechanism that applies ultrasonic waves to the treatment liquid, wherein the treatment tank has a long axis where cross-sectional shapes are substantially identical to each other, and a wall surface to a scheduled liquid level height line of the treatment liquid is formed by a concave surface, and the ultrasonic application mechanism is installed at a position where an angle θ formed by a normal line of an oscillation surface of ultrasonic waves and the scheduled liquid level line of the treatment liquid is 5° to 80°.

11 Claims, 6 Drawing Sheets

(56) References Cited

U.S. PATENT DOCUMENTS

| | | | | |
|---|---|---|---|---|
| 5,501,240 | A | 3/1996 | Dohku et al. | |
| 2006/0065285 | A1* | 3/2006 | Takahashi | F16G 5/16 134/1 |
| 2015/0075572 | A1 | 3/2015 | Ishigami et al. | |
| 2020/0047220 | A1 | 2/2020 | Hoshiba et al. | |

FOREIGN PATENT DOCUMENTS

| | | | |
|---|---|---|---|
| JP | 7-100444 | A | 4/1995 |
| JP | 2000-301087 | A | 10/2000 |
| JP | 2005-46824 | A | 2/2005 |
| JP | 2013-202597 | A | 10/2013 |
| WO | WO2018/169050 | A1 | 9/2018 |

OTHER PUBLICATIONS

Written Opinion of the International Searching Authority for PCT/JP2020/047145 (PCT/ISA/237) dated Mar. 2, 2021, 5 Pages.

* cited by examiner

ULTRASONIC TREATMENT APPARATUS

CROSS-REFERENCE TO RELATED APPLICATION

This application claims the benefits of PCT International Application No. PCT/JP2020/047145 filed on Dec. 17, 2020, which claims priority under 35 U.S.C. § 119(a) to Japanese Patent Application No. 2019-228830 filed on Dec. 12, 2019. The above application is hereby expressly incorporated by reference, in its entirety, into the present application.

TECHNICAL FIELD

The present invention relates to an ultrasonic treatment apparatus.

BACKGROUND ART

Generally, in a manufacturing process of various types of metal objects such as steel plates and steel pipes, a cleaning treatment method is widely used to remove dirt and scales on a surface of the metal object by immersing it in a cleaning tank that contains chemicals (for example, alkaline degreasing agents, surface-active agents, sulfuric acid solutions, and the like), rinses, and so on. Examples of cleaning treatment apparatuses performing such cleaning treatment methods include, for example, a treatment apparatus using high-pressure airflow injection nozzles and an ultrasonic treatment apparatus using ultrasonic waves.

Various methods have been conventionally proposed to improve propagation performance and treatment performance of ultrasonic waves in various surface treatments, including the cleaning treatment, for large materials such as steel plates and steel pipes.

For example, the following Patent Document 1 proposes a technology to improve cleaning performance by ultrasonic waves by providing a swing means to rotate an ultrasonic transducer inside a cleaning tank and by swinging the ultrasonic transducer during cleaning of a cleaning object. The following Patent Document 2 proposes a technology to improve cleaning efficiency by rotating a cleaning object and driving an ultrasonic transducer up and down during the cleaning of the cleaning object. The following Patent Document 3 proposes a technology to provide a curved surface member for reflecting ultrasonic waves against a wall surface and/or a bottom surface of a treatment tank.

PRIOR ART DOCUMENT

Patent Document

Patent Document 1: Japanese Laid-open Patent Publication No. 2000-301087

Patent Document 2: Japanese Laid-open Patent Publication No. 2013-202597

Patent Document 3: International Publication Pamphlet No. WO 2018/169050

DISCLOSURE OF THE INVENTION

Problems to Be Solved by the Invention

However, when various drive mechanisms are installed at a portion of the cleaning tank where a cleaning liquid is contained, as in the above-mentioned Patent Documents 1 and 2, it is necessary to select a treatment liquid that will not adversely affect the drive mechanisms. In addition, an internal space of the cleaning tank cannot be used effectively for a volume of the drive mechanisms to be installed, and the number of treatment objects that can be treated at one time is reduced.

Even when using the technologies described in the above Patent Documents 1 to 3, the propagation performance and uniformity of ultrasonic waves may decrease when multiple treatment objects are arranged in the treatment tank, and there was room for further study on how to improve the propagation performance and uniformity of ultrasonic waves.

Thus, there is a need for a technology that can improve the propagation performance and uniformity of ultrasonic waves more easily, even when treating multiple treatment objects.

The present invention was made in view of the above problems, and an object thereof is to provide an ultrasonic treatment apparatus that can more easily improve the propagation performance and uniformity of ultrasonic waves, even when treating multiple treatment objects.

Means for Solving the Problems

To solve the above problems, the present inventors have studied diligently and found that it is possible to further improve the propagation performance and uniformity of ultrasonic waves by setting a shape of a surface up to a scheduled liquid level height line of a treatment liquid (in other words, a portion in contact with the treatment liquid) of an inner surface of a treatment tank as a concave surface and irradiating ultrasonic waves toward the scheduled liquid level height line of the treatment liquid in the treatment tank.

The summary of the present invention completed based on the above findings is as follows.

(1) An ultrasonic treatment apparatus including: a treatment tank capable of containing a treatment object and a treatment liquid for immersing the treatment object; and an ultrasonic application mechanism that applies ultrasonic waves to the treatment liquid, wherein the treatment tank has a long axis where cross-sectional shapes are substantially identical to each other, and a wall surface up to a scheduled liquid level height line of the treatment liquid is formed by a concave surface, and the ultrasonic application mechanism is installed at a position where an angle θ formed by a normal line of an oscillation surface of ultrasonic waves and the scheduled liquid level line of the treatment liquid is 5° to 80°.

(2) The ultrasonic treatment apparatus according to (1), wherein the ultrasonic application mechanism is installed at a position where the angle θ is 25° to 70°.

(3) The ultrasonic treatment apparatus according to (1) or (2), wherein the ultrasonic application mechanism is not installed at a position where the angle θ is out of the range described in (1) or (2).

(4) The ultrasonic treatment apparatus according to any one of (1) to (3), wherein a cross section of the treatment tank cut in a plane perpendicular to the long axis has a shape where part of an approximate circle or ellipse is cut out.

(5) The ultrasonic treatment apparatus according to any one of (1) to (4), wherein in the cross section of the treatment tank cut in the plane perpendicular to the long axis, a distance between inner walls at the scheduled liquid level height line is 90% or more of a maximum distance M between the inner walls of the treatment tank in the cross section.

(6) The ultrasonic treatment apparatus according to any one of (1) to (5), wherein in the cross section of the treatment tank cut in the plane perpendicular to the long axis, a curvature radius R of the concave surface is 1.0 to 25.0 times a length L of the oscillation surface of the ultrasonic application mechanism in the cross section.

(7) The ultrasonic treatment apparatus according to any one of (1) to (6), wherein the ultrasonic application mechanism is installed to be capable of changing an installation position in the treatment tank in accordance with a treatment amount of the treatment object.

(8) The ultrasonic treatment apparatus according to any one of (1) to (7), wherein the treatment tank is configured to be capable of varying a length in a direction parallel to the long axis of the treatment tank by connecting or detaching treatment tank parts whose cross-sectional shapes in the cross section cut in a direction perpendicular to the long axis are substantially identical to each other.

(9) The ultrasonic treatment apparatus according to any one of (1) to (8), wherein the treatment tank can be attached to and detached from a stand that holds the treatment tank.

(10) The ultrasonic treatment apparatus according to any one of (1) to (9), wherein a portion of the stand holding the treatment tank that is in contact with the treatment tank is made of a material with a specific acoustic impedance of $1\times10^5$ to $2\times10^6$ $kg\cdot m^{-2}\cdot sec^{-1}$.

(11) The ultrasonic treatment apparatus according to any one of (1) to (10), wherein an area of the treatment tank at a contact portion with the stand is 40% or less of an area of an outer surface of the treatment tank.

(12) The ultrasonic treatment apparatus according to any one of (1) to (9), wherein the treatment tank is used in a state isolated from the stand.

(13) The ultrasonic treatment apparatus according to any one of (1) to (12), wherein a treatment liquid circulation path for circulating the treatment liquid is installed outside the treatment tank.

Effect of the Invention

As explained above, the present invention makes it possible to improve propagation performance and uniformity of ultrasonic waves more easily, even when treating multiple treatment objects.

EMBODIMENTS FOR CARRYING OUT THE INVENTION

Hereinafter, suitable embodiments of the present invention will be described in detail with reference to the drawings. In the specification and the drawings presented below, substantially the same components are denoted by the same reference signs, and a duplicated description thereof will be omitted.

Overall Configuration of Ultrasonic Treatment Apparatus

Figure 1A:
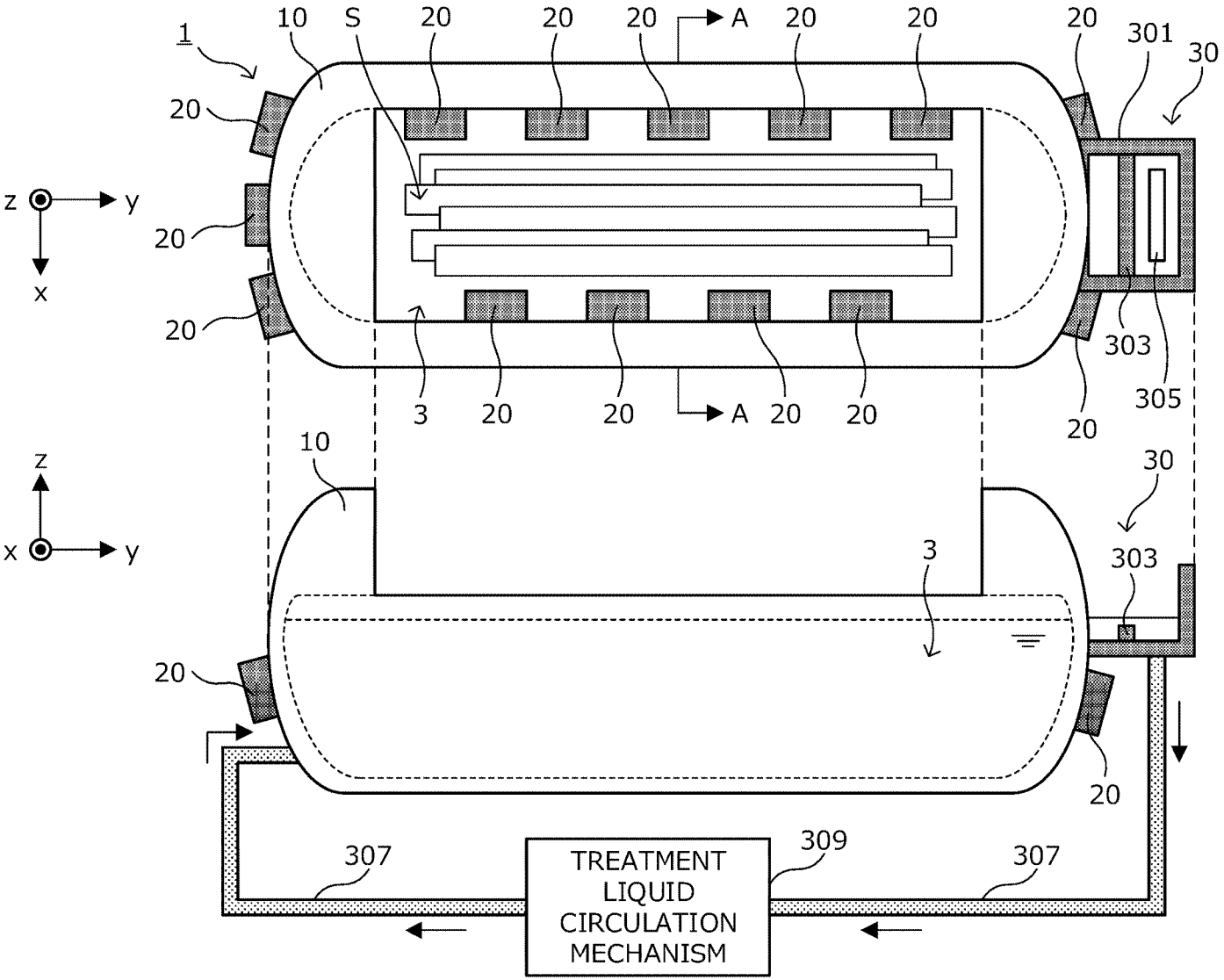
FIG. 1A is an explanatory diagram schematically illustrating an overall configuration of an ultrasonic treatment apparatus according to an embodiment of the present invention.
Figure 1B:
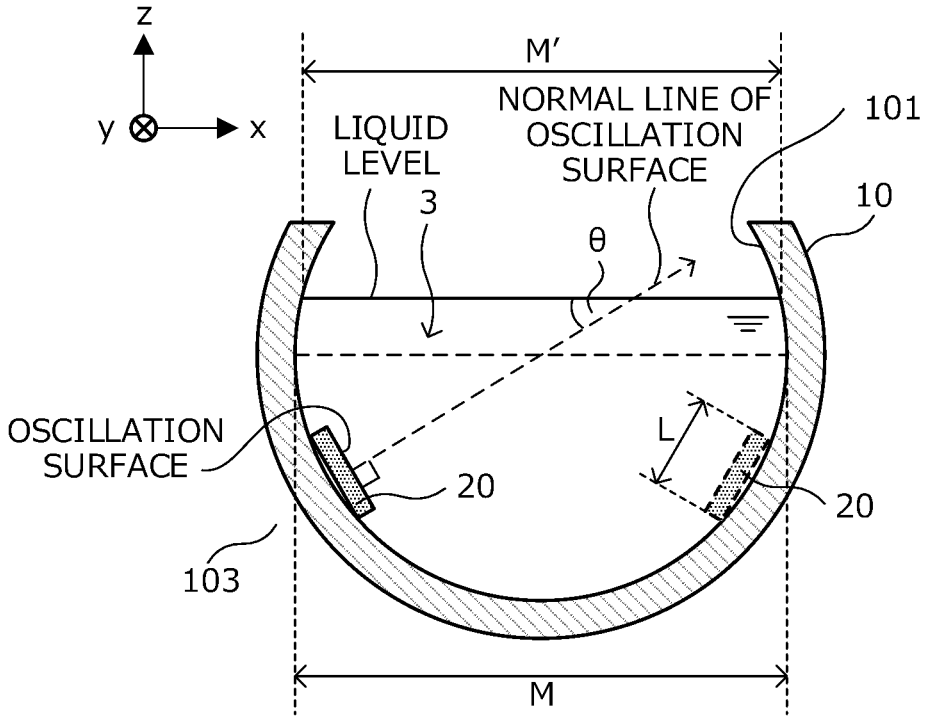
FIG. 1B is an explanatory diagram enlargedly illustrating a cross section of the ultrasonic treatment apparatus according to the embodiment of the present invention cut along an A-A cutting line in FIG. 1A.

First, a brief description of an overall configuration of an ultrasonic treatment apparatus according to an embodiment of the present invention will be given with reference to FIG. 1A and FIG. 1B. FIG. 1A is an explanatory diagram schematically illustrating the overall configuration of the ultrasonic treatment apparatus of this embodiment, and FIG. 1B is an explanatory diagram enlargedly illustrating a cross section of the ultrasonic treatment apparatus according to this embodiment cut along an A-A cutting line in FIG. 1A. A size of each member in the drawings is emphasized as appropriate for ease of explanation and does not indicate actual dimensions or ratios between members.

An ultrasonic treatment apparatus 1 of this embodiment is an apparatus that performs the following treatments for a surface of a treatment object (a portion in contact with a treatment liquid) by applying ultrasonic waves from ultrasonic treatment mechanisms 20 to a treatment liquid 3 under a state where the treatment object is immersed in the treatment liquid 3 contained (or filled) in a treatment tank 10. The ultrasonic treatment apparatus 1 can be used when various treatments such as cleaning, for example, are applied to treatment objects such as various types of metal objects represented by steel materials, and various types of non-metal objects represented by plastic resin members. For example, various types of metal objects such as steel pipes, shape steels, bar steels, and steel wire materials, which extend in a predetermined axial direction, can be treated as the treatment objects by using the ultrasonic treatment apparatus 1 of this embodiment to perform a pickling treatment, a degreasing treatment, and a cleaning treatment (after the pickling treatment, or other treatments) on these metal objects.

The pickling treatment is a treatment to remove oxide scales formed by heat treatment, thermal processing, and the like on a surface of the metal object, and the degreasing treatment is a treatment to remove oil such as lubricant or machining oil used in processing or the like. These pickling and degreasing treatments are pretreatments performed before applying surface finishing treatments (metal coating treatment, chemical conversion treatment, paint treatment, and other treatments) to metal objects. The pickling treatment may dissolve a part of base metal. The pickling treatment is also used to dissolve metal objects by etching to improve surface finishing quality. In some cases, the degreasing treatment is provided before the pickling treatment, and degreasing performance in the degreasing treatment may affect the scale removal in the subsequent pickling treatment. Furthermore, the degreasing treatment is also used to improve wettability, which is an indicator of oil content control as a finishing quality of a final product.

Furthermore, the ultrasonic treatment apparatus 1 of this embodiment, which will be described in detail below, can also be used for cleaning used pipes, pipes that require periodic or irregular dirt removal, or the like in addition to the cleaning process in a manufacturing line as described above.

Thus, the ultrasonic treatment apparatus 1 of this embodiment is mainly applicable to various surface treatments of treatment objects, such as long objects extending along a predetermined axial direction. Long objects where surface treatment films (for example, various oxide films, plating films, coating films after surface treatment finishing treatment, and other films) are generated on surfaces can also be used as the treatment objects. Furthermore, the ultrasonic treatment apparatus 1 of this embodiment can also be used to treat long objects to which unintentional surface attachments, such as oxide scale and oil, for example, have adhered in a film form in addition to the various types of intentionally formed films described above.

In the following, a detailed explanation will be given using an example of a case in which there is the treatment tank 10 where a treatment liquid is contained and a plurality of long objects are immersed in the treatment tank 10 as an aggregate. In this case, the aggregate of the plurality of long objects (treatment object) is immersed in the inside of the treatment tank 10 containing (or filled with) the treatment liquid 3 using a crane or other driving mechanism (not illustrated) that is capable of vertical movement. The aggregate of the plurality of long objects may also be immersed in the treatment tank 10 while bundled together by non-illustrated wires, nets, or the like.

For convenience, coordinate systems illustrated in FIG. 1A and FIG. 1B will be used below, as appropriate. A lower row of FIG. 1A schematically illustrates a side surface of the ultrasonic treatment apparatus 1 seen from an x-axis positive direction and an upper row of FIG. 1A schematically illustrates an upper surface of the ultrasonic treatment apparatus 1 seen from a z-axis positive direction.

As illustrated in FIG. 1A, the ultrasonic treatment apparatus 1 of this embodiment includes the treatment tank 10 in which the treatment liquid 3 is contained and an aggregate of a plurality of long objects, which is an example of a treatment object S (not illustrated in FIG. 1A) is contained, and the ultrasonic application mechanisms 20 that apply ultrasonic waves to the treatment liquid 3. As is clear from the coordinate system illustrated in FIG. 1A, a y-axis direction in the coordinate system is parallel to a long axis direction of the treatment tank 10, and a z-axis direction corresponds to a depth direction of the treatment tank 10.

For convenience of explanation, the expressions "inner wall" and "outer wall" of the treatment tank 10 are used below, but such expressions are for convenience only and do not mean that the treatment tank 10 has a double structure. In the following description, a surface of the treatment tank 10 that can come into contact with the treatment liquid 3 (inner surface) is referred to as the "inner wall" and a surface opposite the inner wall (outer surface) is referred to as the "outer wall".

Here, the treatment tank 10 of the ultrasonic treatment apparatus 1 of this embodiment has a long axis (an axis corresponding to the y-axis direction in FIG. 1A and FIG. 1B) where cross-sectional shapes are substantially identical to each other as schematically illustrated in FIG. 1A and FIG. 1B and a wall surface of an inner wall 101 of the treatment tank 10 up to a scheduled liquid level height line of the treatment liquid 3 (that is, a portion in contact with the treatment liquid 3) is formed by a concave surface. In other words, the treatment tank 10 has a cross-sectional shape where a direction of a center of curvature is in an inner direction of the treatment tank 10 when focusing on a curvature radius of the curved surface that forms the inner wall 101. The cross-sectional shape of the inner wall 101 as illustrated in FIG. 1B is achieved not only a portion along the A-A cutting line in FIG. 1A, but also the case when the treatment tank 10 is cut parallel to the x-axis at any position in the y-axis direction. Owing to the concave surface (recessed on the inner wall 101 side) of the inner wall 101 up to the scheduled liquid level height line of the treatment liquid 3 in the treatment tank 10 (in FIG. 1B, this scheduled liquid level height line is the same as a liquid level of the treatment liquid 3), a location to be a point of peak or inflection of a waveform of ultrasonic waves can be made nonuniform no matter where the ultrasonic application mechanisms 20 are installed on the inner wall 101 or the outer wall 103. This makes it possible to improve propagation of ultrasonic waves in the tank.

FIG. 1B illustrates the case when the cross-sectional shape of the treatment tank 10 is the shape, which is obtained by cutting out part of an approximately cylindrical shape along the y-axis direction (in other words, the cross-sectional shape where part of a circle is cut out) as an example. However, the cross-sectional shape of the inner wall 101 of the treatment tank 10 is not limited as long as the inner wall 101 at a portion in contact with the treatment liquid 3 is a concave surface. For example, it may have a cross-sectional shape where part of an approximate ellipse is cut out. However, it is preferable to have the concave surface that has the cross-sectional shape where part of the approximate circle is cut out, as this simplifies handling of the treatment tank 10. In the treatment tank 10 of this embodiment, a portion of the inner wall that is not in contact with the treatment liquid 3 is not limited and may be formed by a curved surface, or there may be a portion that is not curved.

As illustrated in the upper row of FIG. 1A, the ultrasonic application mechanisms 20 are installed at, for example, the inner wall 101 side and the outer wall 103 side of the treatment tank 10 in the ultrasonic treatment apparatus 1 of this embodiment. Here, there are 5+4=9 pieces of the ultrasonic application mechanisms 20 along the y-axis direction on the inner wall 101 side except near both end portions of the treatment tank 10, and there are 3+3=6 pieces of the ultrasonic application mechanisms 20 on the outer wall 103 side near the both end portions of the treatment tank 10, in FIG. 1A. The number of ultrasonic application mechanisms 20 and installation states thereof are not limited to the example illustrated in FIG. 1A, and may be set appropriately according to a shape, a size, and other factors of the treatment tank 10. For example, the ultrasonic application mechanisms 20 may be installed on only one side of the treatment tank 10 or both sides as illustrated in FIG. 1A. In this case, the ultrasonic application mechanisms 20 in the y-axis direction (long axis direction of the treatment tank 10) are preferably arranged in zigzag. This makes it possible to utilize emitted ultrasonic waves more efficiently. When the ultrasonic application mechanisms 20 are installed on both sides of the treatment tank 10, they may be arranged in zigzag as illustrated in FIG. 1A or they may be symmetrically arranged. The ultrasonic application mechanisms 20 may also be installed along the inner wall 101 in the x-axis direction having the concave surface shape, as illustrated in FIG. 1A. Furthermore, the ultrasonic application mechanisms 20 may be installed only on the inner wall 101 side, or on the outer wall 103 side of the treatment tank 10. Also, the ultrasonic application mechanisms 20 are not arranged near the both end portions of the treatment tank 10, but on the inner wall 101 or the outer wall 103 except near the both end portions of the treatment tank different from FIG. 1A.

As schematically illustrated in FIG. 1B, the ultrasonic application mechanisms 20 are installed such that an angle θ formed by a normal line of an oscillation surface of ultrasonic waves and the scheduled liquid level height line of the treatment liquid 3 (in FIG. 1B, this scheduled liquid level height line is the same as the liquid level of the treatment liquid 3) is 5° or more in the ultrasonic treatment apparatus 1 of this embodiment. When the oscillation surface of ultrasonic waves in the ultrasonic application mechanism 20 satisfies the above relationship, the ultrasonic waves are emitted toward the liquid level of the treatment liquid 3. As a result, reflection efficiency of ultrasonic waves at the liquid level of the treatment liquid 3 is improved, and secondary acoustic waves (that is, reflected waves of the ultrasonic waves at the liquid level) will return to the treatment tank 10, and may further reflect on the inner wall 101 formed by the concave surface. This causes the points of the peaks and inflections in the ultrasonic waveform to exhibit no further specific distribution, and the reflections are repeated inside the treatment tank 10. This propagation state of ultrasonic waves is achieved, and propagation performance and uniformity of ultrasonic waves can be further improved in the ultrasonic treatment apparatus 1 of this embodiment.

When the angle θ illustrated in FIG. 1B exceeds 80°, the treatment object S (not illustrated in FIG. 1B) is more likely to be present on a travel path of primary waves of ultrasonic waves emitted from the oscillation surface, resulting in a low percentage of ultrasonic waves reaching the liquid level. As a result, there is a possibility that the improvement in the propagation performance and uniformity of ultrasonic waves may not be sufficient. From this perspective, the ultrasonic application mechanisms 20 are arranged so that the angle θ illustrated in FIG. 1B is 80° or less in this embodiment. The ultrasonic application mechanism 20 preferably does not emit ultrasonic waves directly to the treatment object S, but rather emits ultrasonic waves toward the liquid level so that the ultrasonic waves are reflected at the liquid level.

From the above perspective, a size of the angle θ formed by the normal line of the oscillation surface of ultrasonic waves and the scheduled liquid level height line of the treatment liquid 3 is set to 5° to 80°. The angle θ is preferably 15° or more, more preferably 25° or more, and even more preferably 30° or more. Such an angle can further improve the efficiency of the ultrasonic application. On the other hand, when the angle θ exceeds 70°, the improvement of the propagation performance and uniformity of the ultrasonic waves may not be sufficient. The angle θ is preferably 70° or less, more preferably 65° or less, and even more preferably 60° or less. Such an angle can further improve the propagation performance and uniformity of ultrasonic waves.

In the ultrasonic treatment apparatus 1 of this embodiment, it is preferable that the ultrasonic application mechanisms 20 do not exist outside the range of the above angle θ. That is, the ultrasonic application mechanisms 20 are preferably installed only within the range of the above angle θ. By arranging the ultrasonic application mechanisms 20 in this manner, the propagation performance and uniformity of ultrasonic waves can further be improved.

Here, the plurality of ultrasonic application mechanisms 20 may not have the same value of the angle θ in this embodiment. They may have multiple values of the angle θ within the above range. However, by using the same angle θ, an installation cost can be reduced.

Figure 2A:
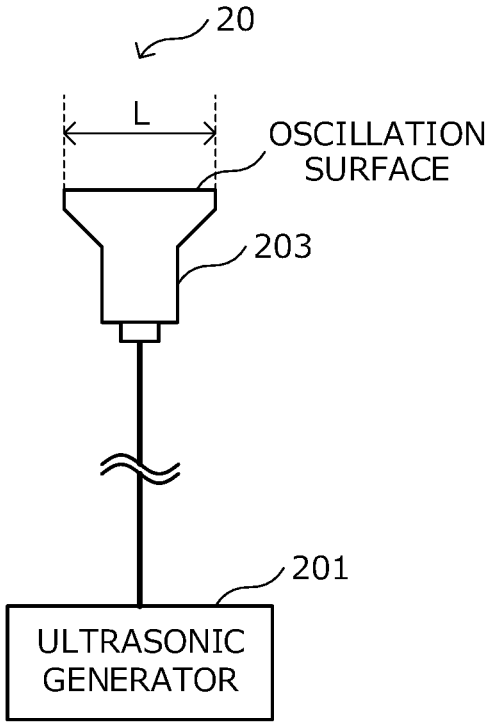
FIG. 2A is an explanatory diagram to explain an ultrasonic application mechanism in the ultrasonic treatment apparatus according to the embodiment.
Figure 2B:
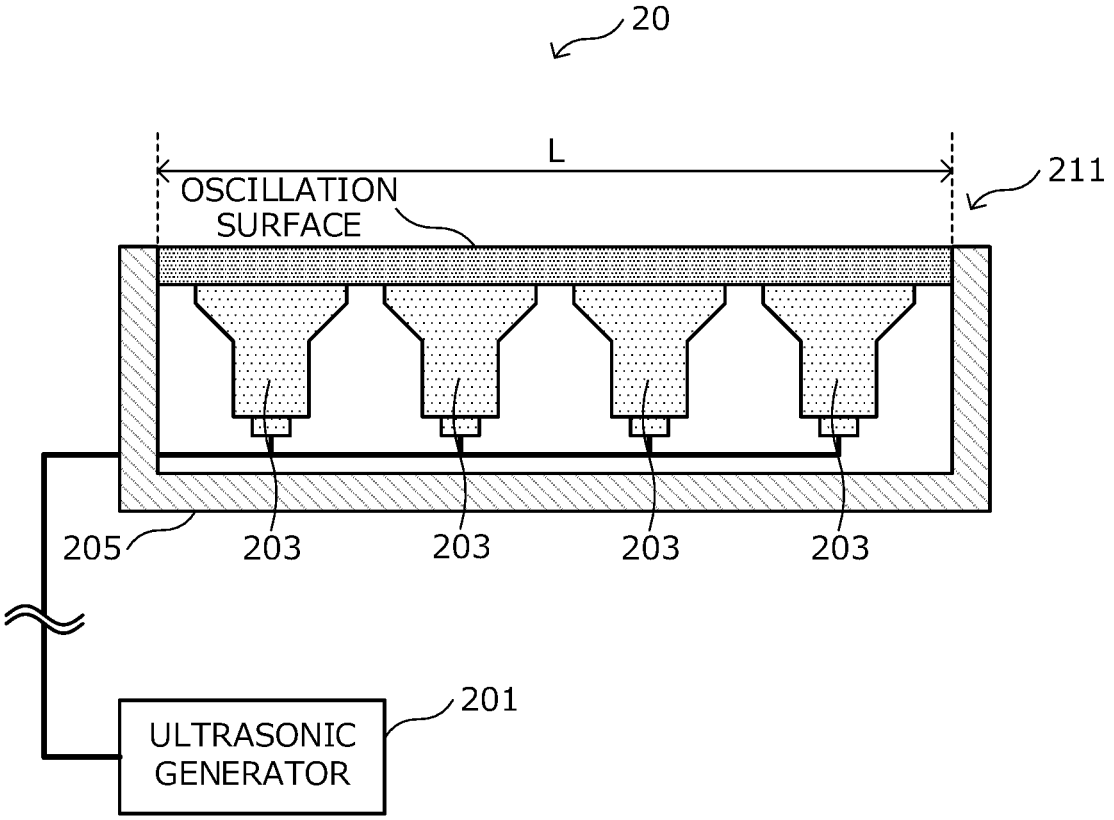
FIG. 2B is an explanatory diagram to explain an ultrasonic application mechanism in the ultrasonic treatment apparatus according to the embodiment.

FIG. 2A and FIG. 2B are explanatory diagrams each schematically illustrating an example of a configuration of the ultrasonic application mechanism 20 of this embodiment.

The ultrasonic application mechanism 20 of this embodiment may be formed by, for example, an ultrasonic generator 201 and an ultrasonic transducer 203 as illustrated in FIG. 2A. The ultrasonic generator 201 is a device that supplies power to the ultrasonic transducer 203 at desired power output. The ultrasonic transducer 203 converts electric power output from the ultrasonic generator 201 into vibration and emits ultrasonic waves at a desired frequency from the oscillation surface. By installing the ultrasonic transducer 203 portion of the ultrasonic application mechanism 20 against the treatment tank 10, ultrasonic waves can be emitted to the treatment liquid 3.

The ultrasonic application mechanism 20 of this embodiment may be formed by, for example, the ultrasonic generator 201, and an immersion ultrasonic vibrator 211 as illustrated in FIG. 2B. The immersion ultrasonic vibrator 211 is formed by sealing a casing 205 in which the plurality of ultrasonic transducers 203 are arranged inside the casing 205 with a member made of a predetermined material that transmits ultrasonic waves to cover the oscillation surface of each ultrasonic transducer 203 as illustrated in FIG. 2B. In this case, the member provided to cover the oscillation surface of each ultrasonic transducer 203 becomes an oscillation surface of the immersion ultrasonic vibrator 211. In the case of the immersion ultrasonic vibrator 211, intervals and the number of ultrasonic transducers 203 and a size of the oscillation surface are determined in consideration of ultrasonic output stability and oscillation efficiency. The ultrasonic application mechanism 20 of FIG. 2A or FIG. 2B can be installed at either or both of the inner wall 101 and outer wall 103.

The frequency of ultrasonic waves output from the ultrasonic application mechanism 20 is, for example, preferably 18 kHz to 200 kHz. When the frequency is less than 18 kHz, the waves change to the frequency in the audible range, and propagation in solids results in significant attenuation although propagation in liquids is possible. Furthermore, ultrasonic waves may be perceived as noise, which may lead to deterioration of work environment. In addition, ultrasonic propagation may be inhibited by large-sized bubbles generated from a surface of the treatment object S, which may reduce effectiveness of ultrasonic waves in improving treatment performance. The frequency of ultrasonic waves output from the ultrasonic application mechanism 20 is more preferably 18 kHz or more. On the other hand, when the frequency of ultrasonic waves exceeds 200 kHz, a straight advancing property of ultrasonic waves when treating the treatment object becomes too strong, and the uniformity of treatment may be lowered. The frequency of ultrasonic waves output from the ultrasonic application mechanism 20 is more preferably 150 kHz or less, and even more preferably 100 kHz or less.

The frequency of ultrasonic waves to be applied is preferably selected to an appropriate value within the above range depending on a type of the treatment object, and the like. Depending on the type of the treatment object, ultrasonic waves at two or more frequencies may be applied.

The ultrasonic application mechanism 20 may also have a frequency sweep function, which is capable of applying ultrasonic waves while sweeping the frequency within a predetermined range centered on a certain selected frequency of ultrasonic waves. Such a frequency sweep function enables to achieve the following further effects.

A phenomenon is known that "transmittance of ultrasonic waves transmitting through an irradiation object reaches its maximum when a wavelength of the ultrasonic waves is ¼ of a wavelength corresponding to a thickness of the irradiation object" as a general property of ultrasonic waves. Therefore, it is possible to increase ultrasonic waves transmitted into a tubular body, when, for example, the treatment object has a hollow portion such as the tubular body, by applying ultrasonic waves while sweeping the frequency within an appropriate range. The treatment efficiency of the ultrasonic treatment apparatus 1 of this embodiment can be thereby further improved.

To ensure that ultrasonic waves are reflected at the inner wall 101, the inner wall 101 of the treatment tank 10 is preferably formed of a material capable of reflecting ultrasonic waves. More precisely, the inner wall 101 of the treatment tank 10 is preferably made of a material having a specific acoustic impedance of $1\times10^7$ $kg\cdot m^{-2}\cdot sec^{-1}$ to $2\times10^8$ $kg\cdot m^{-2}\cdot sec^{-1}$. By forming the inner wall 101 using a material whose acoustic impedance is within the above range, the inner wall 101 can reflect ultrasonic waves more reliably. The "material of the inner wall 101 of the treatment tank 10" is the "material of the treatment tank 10" when the treatment tank 10 is made from a single material (rather than a double structure, or other structures). The treatment tank 10 may have the double structure, a three-layer structure, and so on. In this case, the "material of the inner wall 101 of the treatment tank 10" means "the material of the inner wall 101 of the treatment tank 10" as it is described.

Examples of the material having the acoustic impedance of $1\times10^7$ $kg\cdot m^{-2}\cdot sec^{-1}$ to $2\times10^8$ $kg\cdot m^{-2}\cdot sec^{-1}$ or less include various metals or metal oxides and various ceramics including non-oxide ceramic, for example. Concrete examples of such materials include, for example, steel (specific acoustic impedance [unit: $kg\cdot m^{-2}\cdot sec^{-1}$]: $4.70\times10^7$, hereafter, a numeric value in parentheses represents a value of the specific acoustic impedance as well), iron ($3.78\times10^7$), nickel-chromium steel ($3.98\times10^7$), stainless steel (SUS, $4.57\times10^7$), titanium ($2.73\times10^7$), zinc ($3.00\times10^7$), nickel ($5.35\times10^7$), aluminum ($1.73\times10^7$), brass ($4.06\times10^7$), duralumin ($1.71\times10^7$), tungsten ($1.03\times10^8$), glass ($1.32\times10^7$), quartz glass ($1.27\times10^7$), glass lining ($1.67\times10^7$), alumina (aluminum oxide, $3.84\times10^7$), zirconia (zirconium oxide, $3.91\times10^7$), silicon nitride (SiN, $3.15\times10^7$), silicon carbide (SiC, $3.92\times10^7$), tungsten carbide (WC, $9.18\times10^7$), and so on. In the treatment tank 10 of this embodiment, the material used to form the inner wall 101 may be selected as appropriate according to liquid properties of the treatment liquid 3 to be contained, strength required for the treatment tank 10, and other factors, but it is preferable to use various metals or metal oxides having the acoustic impedance as described above.

As schematically illustrated in FIG. 1A, the ultrasonic treatment apparatus 1 of this embodiment is preferably provided with a treatment liquid circulation path 30 for circulating the treatment liquid 3 outside the treatment tank 10. This treatment liquid circulation path 30 includes, for example, an overflow section 301 where the treatment liquid 3 overflowing from the treatment tank 10 reaches, a partition plate 303 provided inside the overflow section 301, a treatment liquid suction port 305 provided at, for example, a bottom surface of the overflow section 301, a treatment liquid circulation pipe 307, and a treatment liquid circulation mechanism 309.

The treatment liquid 3 overflowing from the treatment tank 10 flows into the overflow section 301 and is held at a portion located on the treatment tank 10 side of the overflow section 301 until the treatment liquid 3 reaches a height of the partition plate 303. When the treatment liquid 3 reaches the height of the partition plate 303, it flows over the partition plate 303 and flows into a side where the treatment liquid suction port 305 is located. The treatment liquid 3 that has reached a vicinity of the treatment liquid suction port 305 is sucked into the treatment liquid circulation pipe 307 by the treatment liquid circulation mechanism 309 such as a pump and returned to the inside of the treatment tank 10.

A fine bubble supply mechanism (not illustrated) for supplying fine bubbles to the treatment liquid may be provided at a part of the treatment liquid circulation path 30. By providing the fine bubble supply mechanism at the treatment liquid circulation path 30, the treatment performance by the treatment liquid 3 can further be improved.

Hereinabove, a brief description of the overall configuration of the ultrasonic treatment apparatus 1 of this embodiment is given with reference to FIG. 1A and FIG. 1B.

Treatment Tank 10 and Ultrasonic Application Mechanism 20

Subsequently, the treatment tank 10 and the ultrasonic application mechanism 20 in the ultrasonic treatment apparatus 1 of this embodiment are described in more detail with reference to FIG. 1B to FIG. 6. FIG. 3 to FIG. 6 are explanatory diagrams to explain the ultrasonic treatment apparatus of this embodiment.

In any cross section cut perpendicular to the long axis direction (y-axis direction in FIG. 1B) of the treatment tank 10, a maximum distance between the inner walls of the treatment tank 10 between a depth direction (z-axis direction in FIG. 1B) and a direction (x-axis direction in FIG. 1B) perpendicular to the long axis direction (y-axis direction in FIG. 1B) of the treatment tank 10 is denoted as M. This maximum distance M between the inner walls corresponds to a size of a diameter of a circle forming a cylinder, for example, in a cross-sectional shape as illustrated in FIG. 1B, where part of a cylindrical shape is cut out. In this case, a length M' of a liquid level in the scheduled liquid level height line (the same as the liquid level of the treatment liquid 3 in FIG. 1B) in a direction vertical to the long axis direction of the treatment tank 10 (x-axis direction in FIG. 1B) in the cross section is preferably 90% or more of the maximum distance M between the inner walls. An upper limit of the length M' of the liquid level is not specified and may coincide with the maximum distance M between the inner walls. That is, the upper limit of the length M' of the liquid level is 100% of the maximum distance M between the inner walls.

In this embodiment, emphasis is on reflecting ultrasonic waves emitted from the oscillation surface of the ultrasonic application mechanism 20 at the liquid level of the treatment liquid 3, as mentioned above. From this perspective, the longer the length M' of the liquid level, the larger a reflection area of the ultrasonic waves can be obtained. Here, when the angle θ illustrated in FIG. 1B is increased, reflection of ultrasonic waves at the liquid level can be fully achieved even if the length M' of the liquid level is short because the oscillation surface of the ultrasonic application mechanism 20 will face the liquid level (concretely, because the normal line (of the oscillation surface) from a center of a length L of the oscillation surface intersects the scheduled liquid level line of the treatment liquid). On the other hand, when the angle θ illustrated in FIG. 1B is reduced, the oscillation surface of the ultrasonic application mechanism 20 faces the wall surface rather than the liquid level, so the length M' of the liquid level is preferably set to be as long as possible to maintain the reflection efficiency of ultrasonic waves at the liquid level. When M'/M is 90% or more, the ultrasonic waves emitted from the oscillation surface will collide directly with the liquid level rather than with the inner wall 101, resulting in a high reflection efficiency of ultrasonic waves at the liquid level.

As a result of diligent study of a lower limit of the length M' of the liquid level from the above perspective, it became clear that the reflection efficiency of ultrasonic waves at the liquid level can be maintained in a favorable state when the length M' of the liquid level is 90% or more of the maximum distance M between the inner walls. From this perspective, the length M' of the liquid level is preferably 90% or more, more preferably 93% or more, and even more preferably 95% or more of the maximum distance M between the inner walls.

At any cross section of the treatment tank 10 cut in the depth direction of the treatment tank 10 (z-axis direction in FIG. 1B), to be perpendicular to the long axis direction of the treatment tank 10 (y-axis direction in FIG. 1B) as illustrated in FIG. 1B, a length of the oscillation surface of the ultrasonic application mechanism 20, as illustrated in FIG. 2A and FIG. 2B, is denoted as L. In this case, a curvature radius R of the concave surface forming the inner wall 101 at a portion in contact with the treatment liquid 3 is preferably 1.0 times to 25.0 times the length L of the oscillation surface. That is, R/L, is preferably 1.0 to 25.0. When the curvature radius R is less than 1.0 times the length L of the oscillation surface, a distance to the treatment object S becomes too close and a distance for ultrasonic reflection at the liquid level cannot be secured. The curvature radius R of the concave surface forming the inner wall 101 at the portion in contact with the treatment liquid 3 is more preferably 2.0 times or more, even more preferably 3.0 times or more, and further more preferably 4.0 times or more with respect to the length L of the oscillation surface. On the other hand, when the curvature radius R exceeds 25.0 times the length L of the oscillation surface, the distance between the ultrasonic oscillation surface and the liquid level becomes farther, which causes diffusion of ultrasonic waves due to diffraction phenomena, and not all of the emitted ultrasonic waves reach the liquid level, to reduce the effect of the curvature radius. When the curvature radius R satisfies the above relationship, ultrasonic waves can be propagated more reliably throughout the treatment tank 10, and more efficient propagation of ultrasonic waves around the treatment object S can be achieved. The curvature radius R of the concave surface forming the inner wall 101 at the portion in contact with the treatment liquid 3 is more preferably 20.0 times or less, further preferably 17.0 times or less, even more preferably 14.0 times or less, and further more preferably 11.0 times or less with respect to the length L of the oscillation surface.

Here, when individual ultrasonic transducer 203 as illustrated in FIG. 2A is installed, the length L of the oscillation surface is adjusted by changing a size of a oscillation surface of the individual ultrasonic transducer 203. In the case of installing the immersion ultrasonic vibrator 211 as illustrated in FIG. 2B, the length L of the oscillation surface can be adjusted more easily by changing the number of ultrasonic transducers 203 arranged in the casing 205 and intervals between them.

In general, an efficient size of a transducer when emitting ultrasonic waves is determined when the output of the ultrasonic generator 201 is set. When using individual ultrasonic generator 201 as illustrated in FIG. 2A, the length L of the oscillation surface can be adjusted finely by changing an aspect ratio, diameter, and the like of the oscillation surface, but the adjustment range is small. Therefore, considering the possibility of installing individual ultrasonic generator 201 as illustrated in FIG. 2A, it is more convenient to adjust the curvature radius R within an acceptable range than to adjust the length L of the oscillation surface when adjusting the relationship between the length L of the oscillation surface and the curvature radius R. On the other hand, when it is difficult to change the size of the treatment tank 10, namely, R, the ultrasonic application mechanism 20 with the length L of the oscillation surface such that R/L is in a preferred range may be used.

When the size (volume) of the treatment tank 10 is set to a large value, it is preferable to adjust the length of the treatment tank 10 in the long axis direction (y-axis direction in FIG. 1B) while maintaining the curvature radius R of the concave surface forming the inner wall 101 to satisfy the above relationship. However, even in this case, the length of the treatment tank 10 in the long axis direction is preferably set to 1 m or more. When the length in the long axis direction is less than 1 m, there is an increased possibility that the size of the treatment object S will be excessively restricted, and also a difference in effectiveness of the concave surface, which forms the inner wall 101, and an inner wall in a typical ultrasonic treatment apparatus becomes small. On the other hand, there is no particular upper limit for the length in the long axis direction, and when the long axis direction is made longer, the adjustment may be made by increasing the number of ultrasonic application mechanisms 20 to be arranged.

The treatment tank 10 may be configured such that the length in the long axis direction can be varied by preparing treatment tank parts (not illustrated) having approximately identical cross-sectional shapes in the cross sections cut perpendicular to the long axis direction in the depth direction (z-axis direction) of the treatment tank 10, and connecting or detaching such treatment tank parts. By configuring the treatment tank 10 in such a way that it can be divided, the length of the treatment tank 10 in the long axis direction can be adjusted more easily.

Figure 3:
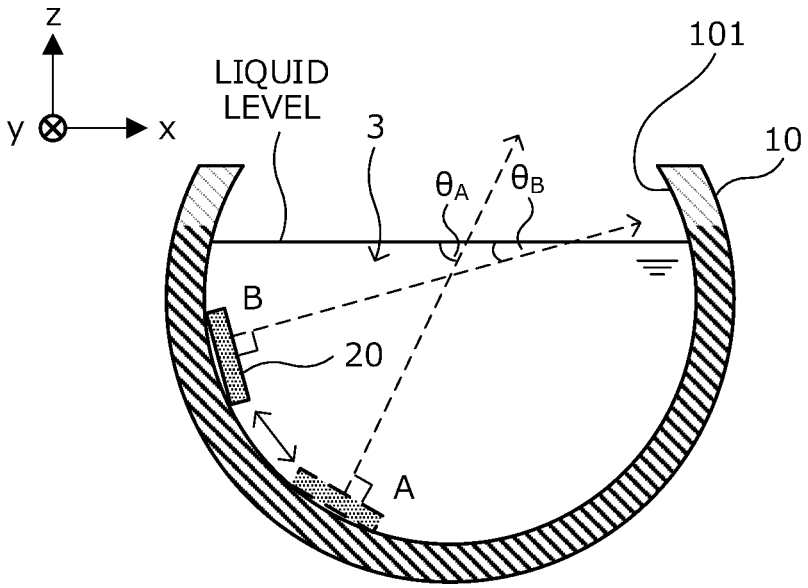
FIG. 3 is an explanatory diagram to explain the ultrasonic treatment apparatus according to the embodiment.

As schematically illustrated in FIG. 3, the ultrasonic application mechanism 20 is preferably installed in such a way that an installation position of the ultrasonic application mechanism 20 in the treatment tank 10 can be changed according to a treatment amount, or the like of the treatment object S (not illustrated in FIG. 3). In more detail, the installation position of the ultrasonic application mechanism 20 in the treatment tank 10 is preferably made to be changeable so that the more the amount of the treatment object S immersed in the treatment liquid 3 increases, the smaller the angle θ formed by the normal line of the oscillation surface and the liquid level becomes.

As schematically illustrated in FIG. 3, the closer the installation position of the ultrasonic application mechanism 20 is to the bottom of the treatment tank 10 (for example, installation position A in FIG. 3), the larger the size of the angle θ (for example, angle $\theta_A$ in FIG. 3), and the higher a percentage of the primary wave of ultrasonic waves that are intercepted by the treatment object S and do not reach the liquid level. By moving the installation position of the ultrasonic application mechanism 20 closer to the liquid level (for example, installation position B in FIG. 3), the size of the angle θ becomes smaller (for example, angle $\theta_B$ in FIG. 3), propagation of ultrasonic waves around the treatment object S can be achieved while maintaining the percentage of the primary wave reaching the liquid level.

A mechanism for changing the installation position of the ultrasonic application mechanism 20 is not limited, and various mechanisms can be employed as appropriate. For example, by providing a rail (not illustrated) or other mechanisms for moving and fixing the ultrasonic application mechanism 20 on the inner wall 101 of the treatment tank 10, the installation position of the ultrasonic application mechanism 20 can be adjusted easily so that the angle θ becomes a desired value. Such a rail mechanism occupies less space in the treatment tank 10, and it is possible to use various types of treatment liquids 3 as needed by applying appropriate surface treatment to the rail.

Figure 4A:
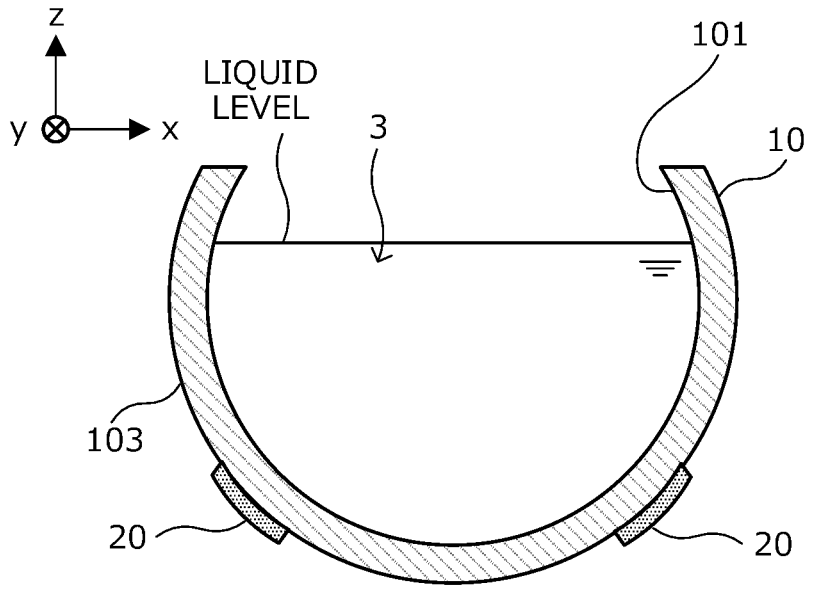
FIG. 4A is an explanatory diagram to explain the ultrasonic treatment apparatus according to the embodiment.
Figure 4B:
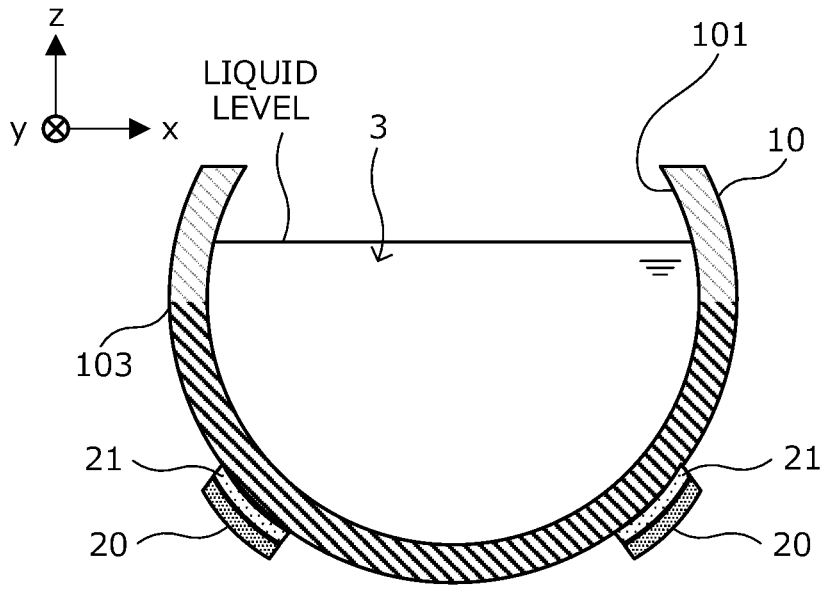
FIG. 4B is an explanatory diagram to explain the ultrasonic treatment apparatus according to the embodiment.

In FIG. 1A to FIG. 3, the cases in which the ultrasonic application mechanisms 20 are mainly installed on the inner wall side of the treatment tank 10 are illustrated, but the ultrasonic application mechanisms 20 may be installed on the outer wall 103 side of the treatment tank 10 in the ultrasonic treatment apparatus 1 of this embodiment as schematically illustrated in FIG. 4A. In this case, the ultrasonic application mechanism 20 is preferably installed such that the shape of the oscillation surface is along the outer wall 103 of the treatment tank 10 as illustrated in FIG. 4A to more reliably propagate ultrasonic waves emitted from the oscillation surface of the ultrasonic application mechanism 20 in the treatment liquid 3. In the case illustrated in FIG. 4A, the length L of the oscillation surface described in FIG. 1B is a length of an arc of the oscillation surface along the outer wall 103 of the treatment tank 10.

When the ultrasonic application mechanism 20 is installed on the outer wall 103 side of the treatment tank 10, a method of fixing the ultrasonic application mechanism 20 is not limited, as long as it is possible to hold the oscillation surface of ultrasonic waves of the ultrasonic application mechanism 20 in contact with the outer wall 103 of the treatment tank 10.

When the ultrasonic application mechanism 20 is fixed to the outer wall 103 of the treatment tank 10 through an adhesive layer 21 using various types of adhesives, or the like, a thickness of the adhesive layer 21 is preferably set to 1 mm or less so as not to be affected by an adhesive material as much as possible to ensure more reliable propagation of ultrasonic waves to the treatment liquid 3. The ultrasonic transducer portion of the ultrasonic application mechanism 20 and the treatment tank 10 are preferably made of equivalent materials or materials having approximate specific acoustic impedance, and are preferably fixed, bonded, or joined so that there are no gaps and air layers (including air bubbles).

Figure 5:
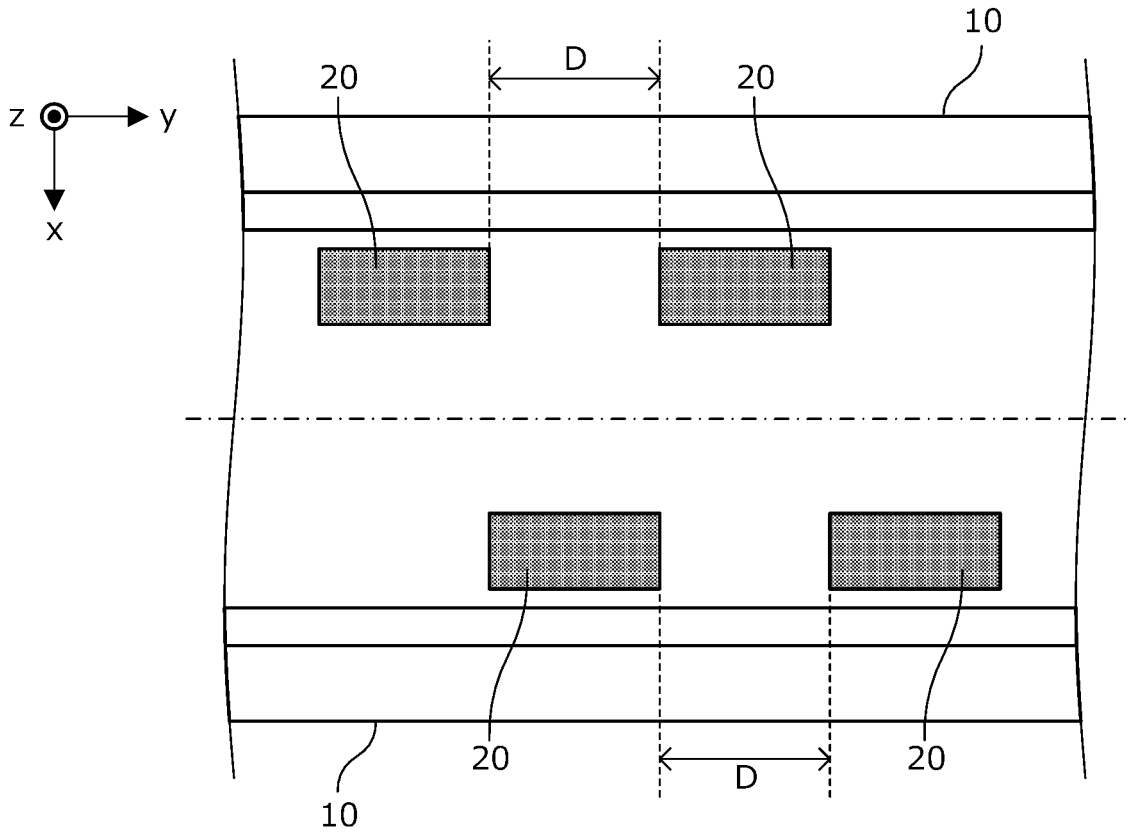
FIG. 5 is an explanatory diagram to explain the ultrasonic treatment apparatus according to the embodiment.

As illustrated in FIG. 5, an installation interval D of the ultrasonic application mechanisms 20 in the long axis direction (y-axis direction) of the treatment tank 10 is preferably spaced to an extent that adjacent transducers do not interfere with each other. An upper limit of the installation interval D is not specified and can be set at any desired interval. The ultrasonic application mechanism 20 may be installed in either of the directions (x-axis direction and y-axis direction) perpendicular to the depth direction of the treatment tank 10 while maintaining the curvature radius R of the concave surface forming the inner wall 101 to satisfy the above-mentioned relationship.

Figure 6:
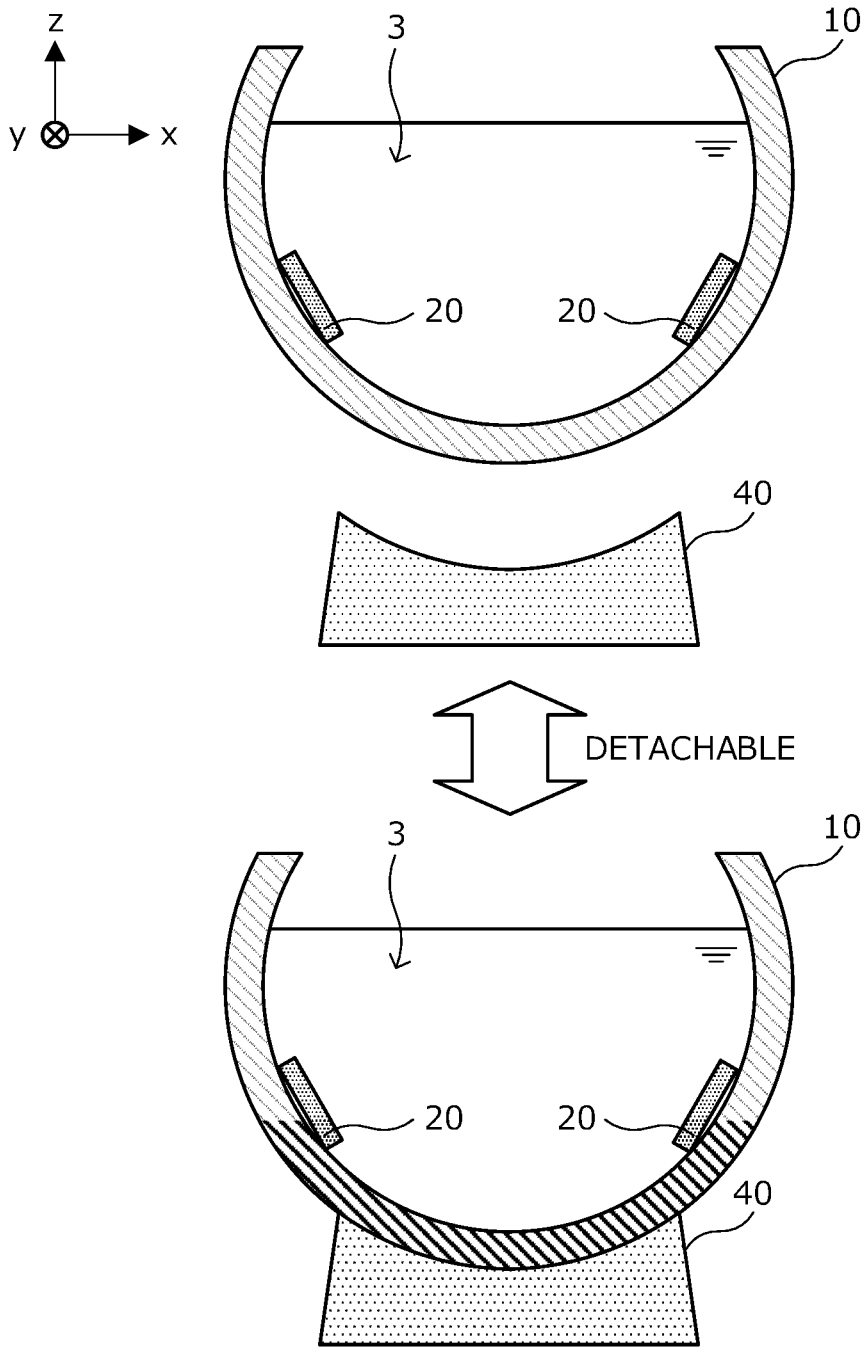
FIG. 6 is an explanatory diagram to explain the ultrasonic treatment apparatus according to the embodiment.

As schematically illustrated in an upper row of FIG. 6, the treatment tank 10 of this embodiment is preferably installed in such a way that it can be attached to and detached from a stand 40 that holds the treatment tank 10. Further, the ultrasonic treatment apparatus 1 of this embodiment can be used in a state in which the treatment tank 10 is isolated from the stand 40 (in other words, independent or separated state from the stand 40), for example, the treatment tank 10 is lifted by a lifting mechanism such as a crane (not illustrated). By using the treatment tank 10 in such a state, it is possible to treat the treatment object S while more reliably suppressing attenuation of ultrasonic waves applied to the treatment liquid 3.

The ultrasonic treatment apparatus 1 of this embodiment can also be used with the treatment tank 10 held on the stand 40 as illustrated in the lower row of FIG. 6. In this case, ultrasonic waves transmitted through the treatment tank 10 may be attenuated at a portion in contact with the stand 40 (in other words, at an interface between the treatment tank 10 and the stand 40). Therefore, the portion of the stand 40 in contact with the treatment tank 10 preferably has a material having a specific acoustic impedance of $1\times10^5$ to $2\times10^6$ $kg\cdot m^{-2}\cdot sec^{-1}$ or less to more reliably suppress the attenuation of ultrasonic waves at the interface between the treatment tank 10 and the stand 40. The presence of such a material makes it possible to increase a difference between the specific acoustic impedance of the material forming the treatment tank 10 and the specific acoustic impedance of the material forming the stand 40, and the attenuation of ultrasonic waves can be suppressed more reliably. Examples of such materials include, for example, silicone rubber ($1\times10^6$ $kg\cdot m^{-2}\cdot sec^{-1}$), natural rubber ($1.46\times10^6$ $kg\cdot m^{-2}\cdot sec^{-1}$), and polyethylene foam ($1.7\times10^6$ $kg\cdot m^{-2}\cdot sec^{-1}$).

Furthermore, the stand 40 itself may be formed using wood or plastic resin, for example, such as phenolic resin, as a material. Although wood and plastic resin such as phenolic resin have a slightly larger specific acoustic impedance than the silicone rubber, natural rubber, and polyethylene foam described above, they have a sufficiently small specific acoustic impedance compared to metal. Therefore, the attenuation of ultrasonic waves at the interface between the treatment tank 10 and the stand 40 can be more reliably suppressed.

The more the portion in contact with the stand 40, the more likely it is that ultrasonic waves will be attenuated. From this perspective, an area of the portion of the treatment tank 10 in contact with the stand 40 is preferably 40% or less of a surface area of the treatment tank 10. From the perspective of suppressing the attenuation of ultrasonic waves, the smaller the area of the contact portion in relation to the surface area of the treatment tank 10, the better, and a lower limit value thereof is not specified.

With reference to FIG. 1B to FIG. 6, the treatment tank 10 and ultrasonic application mechanism 20 in the ultrasonic treatment apparatus 1 of this embodiment have been described in more detail.

As explained above, according to this embodiment, the inner wall 101 of the treatment tank 10 in which the treatment liquid 3 is contained has the concave surface, the ultrasonic application mechanisms 20 are installed toward the liquid level at a predetermined angle, and thereby, it is possible to achieve the ultrasonic treatment apparatus 1 in which ultrasonic waves propagate efficiently from the entire treatment tank 10 to the treatment object S. In the ultrasonic treatment apparatus 1, the reflection of ultrasonic waves from the liquid level and the ultrasonic propagation to the treatment object from various angles on the inner wall 101 of the treatment tank 10 enables efficient treatment.

Hereinabove, the ultrasonic treatment apparatus 1 of this embodiment has been described in detail.

EXAMPLES

The ultrasonic treatment apparatus according to the present invention will be concretely described below, showing examples and comparative examples. The examples shown below are only one example of the ultrasonic treatment apparatus of the present invention, and the ultrasonic treatment apparatus of the present invention is not limited to the examples shown below.

SUS material with a thickness of 5 mm (specific acoustic impedance: $4.57\times10^7$ $kg\cdot m^{-2}\cdot sec^{-1}$) was used to form the treatment tank 10. In this process, the length of the treatment tank 10 (length in the y-axis direction in FIG. 1A) was fixed at 5 m, and the cross-sectional shape of the treatment tank 10 was varied. The stand 40 was fabricated using a steel material to match the cross-sectional shape of the treatment tank 10. The area of the contact portion with the stand 40 at the outer surface of the treatment tank 10 was set to be 35%, and a 10-mm-thick polyethylene foam sheet (specific acoustic impedance: $1.7\times10^6$ $kg\cdot m^{-2}\cdot sec^{-1}$) was attached between the stand 40 and the treatment tank 10.

Example 16 below verified the case without the above-mentioned polyethylene foam sheet, Example 17 below verified the case where the area of the contact portion was set to 50%, and Example 18 below verified the case where the area of the contact portion was set to 50% and there was no polyethylene foam sheet. Example 19 below verified the case where the stand 40 made of phenolic resin was used, the area of the contact portion was set to 50%, and there was no polyethylene foam sheet. Example 20 below verified the case where the stand 40 made of wood was used, the area of the contact portion was set to 50%, and there was no polyethylene foam sheet.

Verification was performed while using a used waste oil well pipe, which is 100 mm in outer diameter×2 to 4 m in length, as the treatment object S, by immersing in the treatment tank 10 containing the treatment liquid for three minutes, and then performing a treatment to clean oxide scales remaining in the pipe with water. Clean water with a liquid temperature of 30° C. was used as the treatment liquid. A ratio of the length M' of the liquid level to the maximum distance M between the inner walls (M'/M) was made to be constant at 85%, 90% or 100%, with a percentage adjusted by the height of the liquid level of the treatment liquid.

The ultrasonic generator of the ultrasonic application mechanism 20 had an output of 1200 W, and eight pieces of ultrasonic transducers were fixed to the inner wall side or outer wall side of the treatment tank 10 at an installation interval of 0.5 m for verification. The ultrasonic transducers of the ultrasonic application mechanism 20 installed on the inner wall side of the treatment tank 10 were the immersion ultrasonic vibrator 211 made of SUS (0.4 m in width×0.3 m in length×0.08 m in thickness) as illustrated in FIG. 2B, and were installed so that the length L of the oscillation surface illustrated in FIG. 1B was 0.3 m. In addition, the ultrasonic transducers 203 of the ultrasonic application mechanism 20, which were installed on the outer wall side of the treatment tank 10, each had 0.09 m in diameter×0.15 m in thickness were used. The ultrasonic transducers 203 installed on the outer wall side were installed at positions of 5°, 25°, 30°, 45°, 60°, 70°, or 80°. In the following Examples 9 to 11 and 14, the ultrasonic transducers 203 were arranged alternately at positions of 30° and 60°, 0° and 60°, or 30° and 90°, while shifting the angle θ. A frequency of the applied ultrasonic waves was set to 18 to 192 kHz.

Three pieces of used waste oil well pipes, the treatment object S, were bundled, immersed while being suspended at a center of the treatment tank 10 by a crane, and then cleaning was performed with the treatment tank 10 itself placed on the stand 40, although it was not welded to the stand 40, and ultrasonic intensity was measured as well as performing cleaning evaluation. In Example 6 below, cleaning was performed under a state where the treatment tank 10 was isolated from the stand 40 by further lifting the treatment tank 10 itself using a crane, and ultrasonic intensity was measured as well as performing cleaning evaluation.

The ultrasonic intensity was measured using an ultrasonic level monitor (19001D, manufactured by KAIJO), and the ultrasonic intensities (mV) at 10 points in two rows in a longitudinal direction at a center of the treatment tank were measured. In the long axis direction (y-axis direction) of the treatment tank 10, 10 measurement points were set at measurement intervals of every 0.4 m along the y-axis direction from an end portion. In a cross section (xz plane) of the treatment tank 10, two measurement points were set 0.2 m apart from a center position of the cross section of the treatment tank 10. A total of 20 measurement points were set in the entire treatment tank 10. The obtained 20 measurement values were averaged and a standard deviation σ was calculated. In this case, relative ultrasonic intensity (a measurement result of Comparative Example 1, namely, relative intensity when the measured ultrasonic intensity in the case where the treatment object S was installed in a square tank, assuming irradiation with the transducers arranged on a side surface of the tank, and the measured ultrasonic intensity was set as 1) and the standard deviation σ were calculated to compare the propagation performance of ultrasonic waves into the treatment object S and the treatment tank.

In this experimental example, an oxide scale removal rate on an inner surface of the pipe was measured, and the measured removal rate was evaluated as water-cleaning performance. In more detail, the oxide scales on the inner surface of the pipe before and after water cleaning were photographed using a fiber scope, and the oxide scale removal rate was calculated using a binarized image. The oxide scale removal rate was defined as a percentage of an oxide scale removal amount under each condition to an oxide scale remaining amount before water-cleaning. Evaluation criteria for the water-cleaning performance in Table 1 below are as follows.

Removal rate of oxide scale remaining film
100% or less to 95% or more: A
Less than 95% to 90% or more: B
Less than 90% to 85% or more: C
Less than 85% to 80% or more: D
Less than 80% to 60% or more: E
Less than 60% to 40% or more: F
Less than 40%: G Grades A, B, and C mean that the water-cleaning performance was very good, grade D means that the water-cleaning performance was good, grade E means that the water-cleaning performance was somewhat difficult, and grades F and G mean that the water-cleaning performance was poor. Grades A to D were considered acceptable.

Setting conditions of the treatment tank 10 and ultrasonic application mechanism 20, as well as results obtained, were summarized in Table 1 below.

In the "inner wall cross-sectional shape" column of Table 1 below, the description "parallel" means that the bottom surface of the treatment tank 10 is parallel to the liquid level, and the description "inclined" means that the bottom surface of the treatment tank 10 is oblique (but not curved) to the liquid level. In the "angle θ" column, the description "vertical" means that the ultrasonic transducer of the ultrasonic application mechanism 20 is installed at the bottom surface of the treatment tank 10 (square tank) (that is, θ=90°), and the description "parallel" means that the ultrasonic transducer (immersion ultrasonic vibrator 211) of the ultrasonic application mechanism 20 is installed on the side surface of the treatment tank 10 (square tank) (that is, θ=0°).

TABLE 1

| | TREATMENT TANK | | | ULTRASONIC APPLICATION MECHANISM | | | EVALUATION RESULT | | |
|---|---|---|---|---|---|---|---|---|---|
| | INNER WALL CROSS-SECTIONAL SHAPE | RATIO OF CURVATURE RADIUS R TO LENGTH L OF OSCILLATION SURFACE R/L | RATIO OF LIQUID LEVEL LENGTH M'/M [%] | INSTALLATION POSITION | ANGLE θ [deg] | FREQUENCY [kHz] | RELATIVE ULSRASONIC INTENSITY | STANDARD DEVIATION σ [mV] | CLEANING PERFORMANCE |
| EXAMPLE 1 | CONCAVE SURFACE | 2.5 | 100 | INNER WALL SIDE | 5 | 26 | 2.0 | 15.8 | D |
| EXAMPLE 2 | CONCAVE SURFACE | 2.5 | 100 | INNER WALL SIDE | 25 | 26 | 3.1 | 9.2 | B |
| EXAMPLE 3 | CONCAVE SURFACE | 0.9 | 100 | INNER WALL SIDE | 45 | 26 | 1.8 | 16.2 | C |
| EXAMPLE 4 | CONCAVE SURFACE | 1.3 | 100 | INNER WALL SIDE | 45 | 26 | 2.3 | 11.2 | B |
| EXAMPLE 5 | CONCAVE SURFACE | 2.5 | 100 | INNER WALL SIDE | 45 | 26 | 3.4 | 5.3 | A |
| EXAMPLE 6 | CONCAVE SURFACE | 2.5 | 100 | INNER WALL SIDE | 45 | 26 | 3.5 | 4.7 | A |
| EXAMPLE 7 | CONCAVE SURFACE | 2.5 | 100 | INNER WALL SIDE | 70 | 26 | 3.2 | 8.1 | A |
| EXAMPLE 8 | CONCAVE SURFACE | 2.5 | 100 | INNER WALL SIDE | 80 | 26 | 2.1 | 12.3 | C |
| EXAMPLE 9 | CONCAVE SURFACE | 2.5 | 100 | INNER WALL SIDE | 30, 60 | 26 | 3.2 | 7.8 | A |
| EXAMPLE 10 | CONCAVE SURFACE | 2.5 | 100 | INNER WALL SIDE | 0, 60 | 26 | 3.6 | 14.1 | C |
| EXAMPLE 11 | CONCAVE SURFACE | 2.5 | 100 | INNER WALL SIDE | 30, 90 | 26 | 2.7 | 14.4 | C |
| EXAMPLE 12 | CONCAVE SURFACE | 9.5 | 85 | OUTER WALL SIDE | 30 | 18 | 1.7 | 15.2 | D |
| EXAMPLE 13 | CONCAVE SURFACE | 9.5 | 90 | OUTER WALL SIDE | 30 | 18 | 2.2 | 11.8 | C |
| EXAMPLE 14 | CONCAVE SURFACE | 9.5 | 100 | OUTER WALL SIDE | 30, 60 | 18 | 3.0 | 7.1 | B |
| EXAMPLE 15 | CONCAVE SURFACE | 9.5 | 100 | OUTER WALL SIDE | 60 | 18 | 3.5 | 4.3 | A |
| EXAMPLE 16 | CONCAVE SURFACE | 9.5 | 100 | OUTER WALL SIDE | 60 | 18 | 1.8 | 14.4 | C |
| EXAMPLE 17 | CONCAVE SURFACE | 9.5 | 100 | OUTER WALL SIDE | 60 | 18 | 1.6 | 15.5 | D |
| EXAMPLE 18 | CONCAVE SURFACE | 9.5 | 100 | OUTER WALL SIDE | 60 | 18 | 1.4 | 16.3 | D |
| EXAMPLE 19 | CONCAVE SURFACE | 9.5 | 100 | OUTER WALL SIDE | 60 | 18 | 1.9 | 12.5 | C |
| EXAMPLE 20 | CONCAVE SURFACE | 9.5 | 100 | OUTER WALL SIDE | 60 | 18 | 1.6 | 15.7 | D |
| EXAMPLE 21 | CONCAVE SURFACE | 16.7 | 100 | OUTER WALL SIDE | 60 | 18 | 3.4 | 5.6 | A |
| EXAMPLE 22 | CONCAVE SURFACE | 25.0 | 100 | OUTER WALL SIDE | 60 | 18 | 2.5 | 10.2 | B |
| EXAMPLE 23 | CONCAVE SURFACE | 26.7 | 100 | OUTER WALL SIDE | 60 | 18 | 1.7 | 15.0 | C |
| EXAMPLE 24 | CONCAVE SURFACE | 9.5 | 100 | OUTER WALL SIDE | 60 | 40 | 3.0 | 6.6 | A |
| EXAMPLE 25 | CONCAVE SURFACE | 9.5 | 100 | OUTER WALL SIDE | 60 | 100 | 2.0 | 10.1 | B |
| EXAMPLE 26 | CONCAVE SURFACE | 9.5 | 100 | OUTER WALL SIDE | 60 | 192 | 1.7 | 15.2 | D |
| COMPARATIVE EXAMPLE 1 | PARALLEL | — | 100 | INNER WALL SIDE | VERTICAL | 26 | 1.0 | 32.1 | G |
| COMPARATIVE EXAMPLE 2 | PARALLEL | — | 100 | INNER WALL SIDE | PARALLEL | 26 | 1.0 | 38.2 | G |

TABLE 1-continued

| | TREATMENT TANK | | | ULTRASONIC APPLICATION MECHANISM | | | EVALUATION RESULT | | |
|---|---|---|---|---|---|---|---|---|---|
| | INNER WALL CROSS-SECTIONAL SHAPE | RATIO OF CURVATURE RADIUS R TO LENGTH L OF OSCILLATION SURFACE R/L | RATIO OF LIQUID LEVEL LENGTH M'/M [%] | INSTALLATION POSITION | ANGLE θ [deg] | FREQUENCY [kHz] | RELATIVE ULSRASONIC INTENSITY | STANDARD DEVIATION σ [mV] | CLEANING PERFORMANCE |
| COMPARATIVE EXAMPLE 3 | PARALLEL | — | 100 | INNER WALL SIDE | 60 | 26 | 1.1 | 30.5 | F |
| COMPARATIVE EXAMPLE 4 | INCLINED | — | 100 | INNER WALL SIDE | 60 | 26 | 1.1 | 25.1 | E |

As it is clear from Table 1 above, in each of the examples corresponding to the comparative examples of the present invention, the relative ultrasonic intensity was a relatively small value, and the cleaning performance failed. On the other hand, in each of the examples corresponding to the examples of the present invention, the relative ultrasonic intensity became a large value and the standard deviation of the ultrasonic intensity became small, and furthermore, excellent cleaning performance was exhibited.

Preferred embodiments of the present invention have been described above in detail with reference to the attached drawings, but the present invention is not limited to the embodiments. It should be understood that various changes and modifications are readily apparent to those skilled in the art who has the common general knowledge in the technical field to which the present invention pertains, within the scope of the technical spirit as set forth in claims, and they should also be covered by the technical scope of the present invention.

EXPLANATION OF CODES

1 ultrasonic treatment apparatus
3 treatment liquid
10 treatment tank
20 ultrasonic application mechanism
21 adhesive layer
30 treatment liquid circulation path
40 stand
101 inner wall
103 outer wall
201 ultrasonic generator
203 ultrasonic transducer
205 casing
211 immersion ultrasonic vibrator
301 overflow section
303 partition plate
305 treatment liquid suction port
307 treatment liquid circulation pipe
309 treatment liquid circulation mechanism

What is claimed is:

1. An ultrasonic treatment apparatus comprising:

a treatment tank capable of containing a treatment object and a treatment liquid for immersing the treatment object; and an ultrasonic application mechanism that applies ultrasonic waves to the treatment liquid, wherein the treatment tank has a long axis where cross-sectional shapes are substantially identical to each other, and a wall surface up to a scheduled liquid level height line of the treatment liquid is formed by a concave surface, the ultrasonic application mechanism is installed at a position where an angle θ formed by a normal line of an oscillation surface of ultrasonic waves and the scheduled liquid level line of the treatment liquid is in a range from 5° to 80°, and in a cross section of the treatment tank cut in a plane perpendicular to the long axis, a curvature radius R of the concave surface is 1.0 to 25.0 times a length L of the oscillation surface of the ultrasonic application mechanism in the cross section.

2. The ultrasonic treatment apparatus according to claim 1, wherein the ultrasonic application mechanism is installed at a position where the angle θ is 25° to 70°.

3. The ultrasonic treatment apparatus according to claim 1, wherein the cross section of the treatment tank cut in the plane perpendicular to the long axis has a shape where part of an approximate circle or ellipse is cut out.

4. The ultrasonic treatment apparatus according to claim 1, wherein in the cross section of the treatment tank cut in the plane perpendicular to the long axis, a distance between inner walls at the scheduled liquid level height line is 90% or more of a maximum distance M between the inner walls of the treatment tank in the cross section.

5. The ultrasonic treatment apparatus according to claim 1, wherein the ultrasonic application mechanism is installed to be capable of changing an installation position in the treatment tank in accordance with a treatment amount of the treatment object.

6. The ultrasonic treatment apparatus according to claim 1, wherein the treatment tank is configured to be capable of varying a length in a direction parallel to the long axis of the treatment tank by connecting or detaching treatment tank parts whose cross-sectional shapes in a cross section cut in a direction perpendicular to the long axis are substantially identical to each other.

7. The ultrasonic treatment apparatus according to claim 1, wherein the treatment tank can be attached to and detached from a stand that holds the treatment tank.

8. The ultrasonic treatment apparatus according to claim 1, wherein a portion of a stand holding the treatment tank that is in contact with the treatment tank is made of a material with a specific acoustic impedance of $1\times10^5$ to $2\times10^6$ $kg\cdot m^{-2}\cdot sec^{-1}$.

9. The ultrasonic treatment apparatus according to claim 1, wherein an area of the treatment tank at a contact portion with a stand is 40% or less of an area of an outer surface of the treatment tank.

10. The ultrasonic treatment apparatus according to claim 1, wherein the treatment tank is used in a state isolated from a stand.

11. The ultrasonic treatment apparatus according to claim 1, wherein a treatment liquid circulation path for circulating the treatment liquid is installed outside the treatment tank.

* * * * *